United States Patent [19]

Klipping

[11] 4,228,662

[45] Oct. 21, 1980

[54] CRYOGENIC APPARATUS

[75] Inventor: Gustav Klipping, Berlin, Fed. Rep. of Germany

[73] Assignee: Deutsche Forschungs- und Versuchsanstalt für Luftund Raumfahrt e.V., Cologne, Fed. Rep. of Germany

[21] Appl. No.: 10,677

[22] Filed: Feb. 6, 1979

[30] Foreign Application Priority Data

Feb. 17, 1978 [DE] Fed. Rep. of Germany ..... 2806829

[51] Int. Cl.[3] ..... F25B 41/04

[52] U.S. Cl. ..... 62/216; 62/514 R

[58] Field of Search ..... 62/514 R, 54, 216, 217

[56] References Cited

U.S. PATENT DOCUMENTS

| | | | |
|---|---|---|---|
| 3,472,038 | 10/1969 | Staas | 62/45 |
| 3,667,246 | 6/1972 | St. Lorant et al. | 62/514 R |
| 3,722,581 | 3/1973 | Saurer | 62/514 R |
| 3,845,636 | 11/1974 | Van Mal et al. | 62/514 R |

*Primary Examiner*—Ronald C. Capossela

*Attorney, Agent, or Firm*—Wenderoth, Lind & Ponack

[57] ABSTRACT

A cryogenic apparatus cools an object to, and maintains it at, very low temperature and is of the kind in which a refrigerating medium comprising superfluid helium II is evaporated from a supply container into an evacuable exhaust system through a throttle element. Such element includes a valve comprising a valve element displaceable relative to a valve sleeve, and the element and sleeve define a passage gap which, in the normal control range, has a width of less than 10 μm and a length determined by the position of the element relative to the sleeve. Such valve may have an additional control range in which the width of the passage gap is greater than 10 μm. The valve element may be a cylindrical plunger which is axially movable within the sleeve and which defines with the sleeve over at least part of its movement an annular gap having a width less than 10 μm. The apparatus may include a regulating means which controls the position of the plunger according to the temperature of the object and also at least one heat exchanger arranged in the exhaust system which is positioned either in the supply container or adjacent the object.

12 Claims, 8 Drawing Figures

CRYOGENIC APPARATUS

BACKGROUND OF THE INVENTION

This invention relates to cryogenic apparatus for cooling objects to and maintaining them at a very low temperature in which by the use of the confinement produced by the thermomechanical effect superfluid helium II is evaporated from a supply container through a throttle element having a narrow passage into an evacuable system.

The use of superfluid helium II for the cooling of objects to a temperature below 2° K. is known for terrestrial and extra-terrestrial purposes, for example, in connection with radiation detectors.

THE PRIOR ART

In the publication by P. M. Selzer, W. M. Fairbank and C. W. F. Everitt, Advanced Cryogenic Engineering 16 (1971) 277–281, the problem of keeping cool a supply of liquid helium under outer space conditions is examined. The authors describe a Dewar vessel wherein a porous plug, consisting of closely wound aluminium foil, is immersed in a liquid supply comprising superfluid helim II, flow gaps of less than $10^{-4}$ cm being formed in the spiral winding. This plug, enclosed in a holder having good thermal conductivity, is positioned at the point of connection of an exhaust system with the supply container and forms a throttle element which, although continuously permitting evaporation of a certain proportion of the liquid, determined by the total cross-section of the pores, and thus enabling a correspondingly limited refrigerating capacity to be achieved, nevertheless affords passage to the helium II liquid only when the inlet temperature at the plug is lower than the outlet temperature and when the pressure on the inlet side is lower than the pressure at the outlet side. With these conditions reversed, the passage of helium II liquid through the plug is completely blocked (thermomechanical effect). A porous plug of this kind thus possesses valve properties that are dependent upon temperature and pressure. However, when use is made of such a plug, superfluid helium II cannot be regulated in a sufficiently inertia free manner as would be necessary for accurately maintaining the cooling temperature, particularly when sudden fluctuations in temperature occur. Since, on the other hand, a small rise in temperature (to 2.18° K.) results in the liquid in the supply container being converted from superfluid helium II into normal helium I, which vaporises through the small pores with considerably more difficulty, there is a danger of a further rise in temperature with a corresponding considerable rise in pressure. The risk of explosions is also present, since plugs containing a small passage cannot bring about a sufficiently rapid equalisation of pressure. Nor is the required degree of safety provided by increasing the area of the plug, i.e. the provision, in parallel, of a large number of channels having a width of gap of below 10 μm.

It is also known to replace wound plugs by porous plugs of ceramic material and sintered metal which can be used as means for separating the helium I and helium II phases, i.e. as cut-off elements for the superfluid substance, and at the same time can function as evaporation openings (see for example, German Federal Pat. No. 1 501 291 and D. Petrac, Low Temp. Physics (Proceedings LT 14) Vol. 4, North Holland/American Elsevier 1975, pp. 33–36).

Because of the unsatisfactory effect of the above-discussed porous or gap-containing plugs, efforts have been made to use, as the throttling and separating element, a simple shuttered aperture in the exhaust gas line. In the publication by P. Mason D. Collins, D. Petrac, L. Yang, F. Edeskuty and K. Williamson ICEG 1976, pages 272 to 277, the results of these investigations are reported and compared with those obtained with porous plugs and it is stated that excessive helium losses occur as regards both normal helium I in the plug system and helium II in the aperture system, so that the cooling apparatus has too short a service-life.

A considerable disadvantage of the known throttling elements resides in the fact that the mass flow of evaporating helium, upon which depends the temperature of the liquid and the refrigerating capacity that can be used for effective cooling, can be influenced only by varying the vacuum at the exhaust side of the element, i.e. under conditions involving considerable inertia. Rapidly changing thermal loads can therefore not be evened out in a sufficiently sensitive manner; furthermore, because of the restricted mass flow, porous plugs limit the refrigerating capacity and the drop in the operating temperature. Furthermore, porous plugs, even if having a relatively large surface, offer only limited passage to normally liquid helium I. In addition, as the supply of refrigerating agent diminishes, i.e. as the vapour content increases in the supply container, regulation of temperature becomes more difficult since the porous plug, which is disposed at the intake of the exhaust system and which likewise offers little passage to helium vapour, no longer has contact with the liquid in any case. This applies despite the thickness of the liquid film of helium II when increased under the conditions of outer space.

It is an object of the present invention to provide cryogenic apparatus having an improved throttle element wich enables:

(a) the control lag to be reduced during a finely controlled variation of the refrigerating capacity provided by the throttle element in the evaporation procedure, (b) the pressures of helium I and helium gas to be rapidly equalised, and (c) the passing of liquid into the exhaust system in controlled amounts.

SUMMARY OF THE INVENTION

According to the invention, this object is achieved in that the throttle element is constituted by a valve which comprises a valve element displaceable relative to a valve sleeve, and in which the element and the sleeve define, in the normal control range, a passage gap having a width which is less than 10 μm and a length which is variable according to the setting of the valve, whereby the output of the valve may be controlled by adjusting the length of the gap.

Such an arrangement permits a finely adjusted control to be carried out with little inertia, particularly because the length of a throttle gap of constant width can be varied in a relatively simple manner, whereas direct control of the opening causes very considerable difficulties in the case of where gap dimensions of less than 10 μm are necessary as here. The throttle element designed as a valve further enables various opening positions to be obtained, so that liquid dispensed in very small quantities can pass into the exhaust system. Because of the valve's ability also to transmit helium gas in an unimpeded manner, the valve can be used not only for adjusting to and maintaining temperatures below 2° K., but can also serve, in a simple manner, as a cool-down valve when the system is cooled from room temperature to the operating temperature. Thus, there is no need for a separate cool-down valve, the sealing of which can cause difficulties when operating with helium II.

In a preferred embodiment, the valve may have an additional control range in which the gap width is greater than 10 μm and may extend to a fully open position. Since, in contrast with porous plugs, the valve can permit unimpeded passage of helium I and gaseous helium, and since the throughput quantities of both media can be regulated virtually as required, dangers due to sudden excess pressure are eliminated, and the supply of refrigerating medium can be fully utilized, this being accompanied by an almost unlimited refrigerating capacity. The use of this valve also offers advantages when it is not, or is only intermittently, in contact with the liquid as is the case when the content in the supply container diminishes.

In an arrangement of advantageous design, the valve element can be constituted by a cylindrical valve plunger which, with the valve sleeve, forms an annular gap having a width of less than 10 μm and which is mounted to be axially displaceable in the valve sleeve. To improve dispensation in small quantities when superfluid helium II, helium I or gaseous helium are to be passed through the valve, the valve plunger may be so shaped that, in conjunction with the valve sleeve, it defines a width of gap greater than 10 μm in an end portion of its path of travel. For this purpose the end of the valve plunger is advantageously tapered, or one or more tapered recesses, which may be arranged symmetrically, are formed in the end of the valve plunger. In a further form, which may be advantageous in some cases, and which can be used whether the plunger is partly tapered or provided with tapered recesses, the valve sleeve has, at at least one end, at least one recess which is parallel with its axis and extends into an annular channel formed between its ends. In this case, the valve can be used both with an annular gap of below 10 μm, and with the extended passage cross-section for admitting liquid. By way of the annular channel within the valve sleeve with which communicates one or more recesses disposed parallel to the longitudinal axis, uniform distribution of the refrigerating medium entering the valve is achieved at the periphery of the opening forming the passage, so that a uniform reliable liquid or gas lubrication is promoted in the annular gap.

In a further embodiment of the invention, the exhaust system may be provided with at least one heat-exchanger which is arranged in the supply container in such a way that it is in heat-exchange relationship with the refrigerating medium. In this way, it becomes possible to exploit the circumstance that the liquid helium II exhibits, at low temperatures, a specific heat which is greater than that of all solid materials to the extent of several orders of magnitude. By means of this heat-exchanger in the refrigerating medium, the refrigeration capacity, occurring at the outlet side of the valve and produced as a result of complete evaporation of a double-phase mixture (helium II—droplets in helium gas), can be carried back to the refrigerating medium. Thus a particularly great constancy in temperature is achieved in the object to be cooled, which may be connected to the cooling medium through heat-conducting holders, supply lines, bridges or the like.

In applications where a relatively high refrigerating capacity is to be applied continuously to the object to be cooled, it may be advantageous, as in a further embodiment of the invention, to bring at least one heat-exchanger in the exhaust system into direct heat-exchange relationship with the object to be cooled. Thus, an advantageous combination is possible by using separate heat-exchangers one in contact with the refrigerating medium and the other in contact with the object to be cooled.

The provision of a heat-exchanger in the container for the refrigerating medium is logical only when a two-phase mixture, partly consisting of super-fluid helium II, occurs at the outlet of the throttling zone. Such an arrangement of the heat-exchanger would not be expedient in the case where the known porous plug is used as the throttling element, and it would in fact be dangerous in some circumstances because of the possibility of heating up of the refrigerating medium. If the supply container contains only normally liquid helium I, then because of the poor thermal conductivity of this liquid, such an arrangement of the heat-exchanger is likewise inexpedient.

When a heat-exchanger is arranged in contact with the object to be cooled and is located in the object chamber, it may be expedient for the exhaust system to be split into two lines, one line including at least one heat-exchanger in the supply container for the refrigerating medium, the other line including a heat-exchanger connected to the object to be cooled. In such case means may be provided for evacuating the two lines differentially.

The improved valve of this invention results in the provision of a throttle element which is particularly suitable for low-inertia regulation of very low temperatures and which, in the form providing an additional control range in which the gap is above 10 μm wide, enables high refrigerating capacities to be briefly applied by direct vaporisation of liquid in the exhaust system. Regulation of temperature by varying the length of the gap while retaining its cross-section constant has been found to be particularly sensitive and therefore improves the constancy in temperature of such regulating arrangements to such an extent that the temperature of the refrigerating medium can be kept constant to within approximately ±0.01° K. If a heat-exchanger in the exhaust system is positioned in the refrigerating medium, a corresponding constancy in temperature is also achieved when the thermal load undergoes great variations.

DESCRIPTION OF THE PREFERRED EMBODIMENTS

Figure 1:
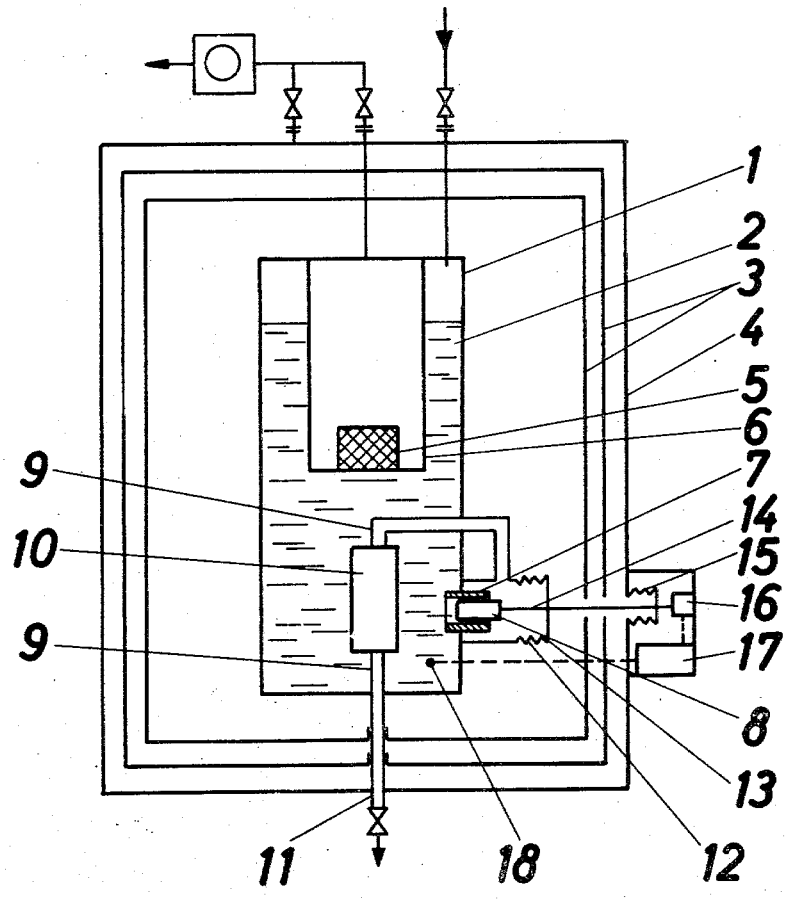
FIG. 1 shows a cryogenic apparatus according to this invention and comprising a throttling valve and a heat-exchanger positioned within the refrigerating medium.
Figure 2:
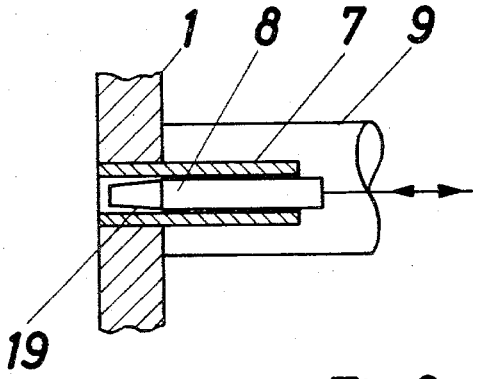
FIG. 2 illustrates an alternative form of valve comprising a valve plunger having a tapered portion.

The cryogenic apparatus shown in FIG. 1 which is for cooling an object in the temperature range below 2° K., comprises a supply container 1 for accommodating a refrigerating medium 2 which contains superfluid helium II. The supply container 1 is surrounded by radiation shields 3 and, together with these, is placed in a vacuum jacket container 4. The necessary connections for evacuation and for introducing the supply of refrigerating medium are of the usual design and are therefore not shown in detail in the drawings.

An object 5 to be cooled is arranged within a cooled chamber 6, in contact with one of the cold walls thereof, and this chamber can likewise be evacuated.

The valve forming the throttle element consists of a sleeve 7, in which a cylindrical valve plunger 8 is axially displaceable. The width of the annular gap between the valve plunger 8 and the interior wall of the sleeve 7 is less than 10 μm. At one end the valve sleeve is open to the refrigerating medium 2 in container 1 and its other end is connected to an exhaust system through a pipe 9 into which is connected a heat-exchanger 10 which is located in the refrigerating medium 2 in the container 1. For the purpose of sealing off the valve 7, 8 without the use of glands, an inner bellows element 12 is provided, through the end plates 13 of which extends a vacuum-sealed valve stem 14. The valve stem 14 which, in the known manner, can be provided with displaceable intermediate portions which facilitate movement of the valve plunger and/or reduce the passage of heat by conduction, extends outwardly through openings in the radiation shields 3 and into the vacuum jacket container 4 by way of an outer bellows element 15 so that a glandless seal is achieved. The movement of the valve stem 14 and therefore the control movement of the valve plunger 8, is effected by an electrodynamic or electromagnetic drive unit 16 which may be designed, for example, to operate in the manner of the moving coil of a loudspeaker or the plunger of a solenoid. The drive unit 16 is so controlled by way of regulating means 17 in dependence upon the temperature of the refrigerating medium 2 as determined by a sensor 18, that the regulating system ensures a constant temperature in the refrigerating medium 2.

In the normal control range of the valve 7, 8, i.e. with a width of annular gap of below 10 μm and a length of gap varying with the refrigerating capacity requirements, superfluid helium II evaporates in dispensable quantities at the exhaust side of the valve plunger 8 under suitable pressure and temperature conditions, the helium II releasing its cold content to the refrigerating medium 2 by way of the heat-exchanger 10. The reduced pressure is achieved by way of a vacuum-pump system of known design, which is connected to the exhaust system at the connection 11. When the apparatus is operating in outer space, the opening of the exhaust system to surrounding space suffices for this purpose, and a vacuum system can then be dispensed with.

Figure 4:
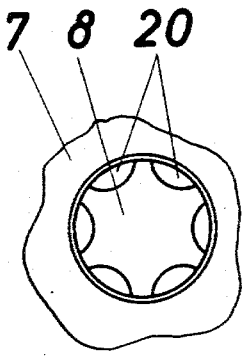
FIGS. 3 and 4 illustrate another form of valve having a plunger with symmetrically disposed tapered recesses.
Figure 3:
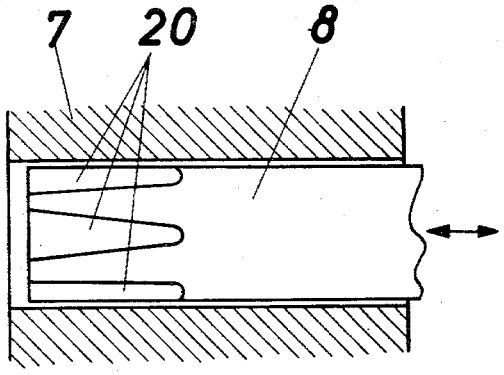

FIGS. 2, 3 and 4, and 5 and 6 illustrate alternative forms of the valve of FIG. 1. In the FIG. 2 arrangement, a tapered portion 19 is provided at the free end of the plunger 8. FIGS. 3 and 4 show a cylindrical valve plunger 8 which has tapered recesses 20 evenly distributed around its periphery at its free end. In the arrangement shown in FIGS. 3 and 4 a more efficient guiding of the valve plunger 8 in the sleeve 7 is achieved as compared with the FIG. 2 arrangement. In the arrangement illustrated in FIGS. 5 and 6, the valve plunger 8 is cylindrical, and in the valve sleeve 7 are formed recesses 21 and 22, which, at both ends of the sleeve extend axially over part of its length, and which communicate with annular grooves 23 and 24 respectively.

In all the above-described arrangements as illustrated in FIGS. 2 to 6, the valve can operate over an additional control range in which the effective width of the annular gap is above 10 μm.

Figure 6:
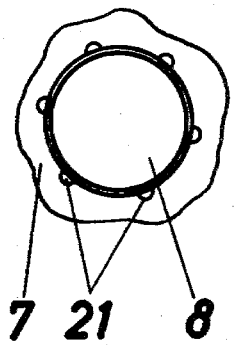
FIGS. 5 and 6 illustrate a further form of valve which has recesses and annular channels in its sleeve.
Figure 5:
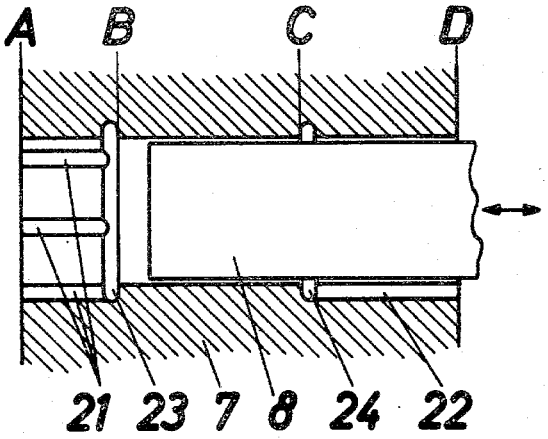

In the arrangement shown in FIGS. 5 and 6, movement of the valve plunger 8, so that its free end is located somewhere between A and C, will vary the axial length of the annular gap between a maximum equal to the distance between B and C, and a minimum when the free end is at C, the width of the gap remaining constant over this range. This is the control range required for smoothing out small fluctuations in temperature. If, however, the free end of the plunger occupies a position between C and D, an annular gap of larger cross-section is uncovered for the passage of liquid helium II and helium I or gaseous helium which enables a larger refrigerating capacity to be provided for a brief period. In this case too, guiding of the valve plunger 8 in the sleeve 7 continues. By way of the annular grooves 23 and 24 which communicate with the recesses 21 and 22 respectively, uniform distribution of the refrigerating medium over the surface of the valve parts is achieved. This also means that refrigerating medium is supplied in a uniform manner to the annular gap so that the valve is efficiently lubricated with liquid or gas and this increases operating efficiency. Suitable selection of the number and cross-sectional area of the recesses 21 and 22 enables the flow cross-section of the valve, opened in the zone of the outlet end recess (C–D), to be suited in the best possible way to the particular application.

Figure 7:
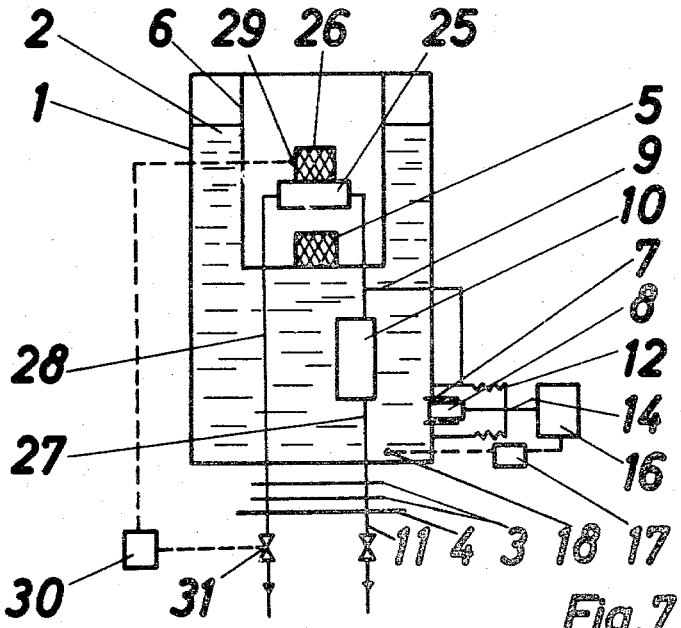
FIG. 7 shows a cryogenic apparatus according to this invention which incorporates one heat-exchanger applied to the object to be cooled and another heat exchanger contained in the refrigerating medium.

FIG. 7 shows a modification of the apparatus of FIG. 1, which in addition to the heat-exchanger 10, disposed in the refrigerating medium 2, incorporates an additional heat-exchanger 25 which is in direct contact with an object 26 to be cooled. The exhaust pipe 9 is divided into two parallel lines 27 and 28 which can be evacuated separately. This provides the possibility of effecting regulation in two regulating systems, the first of these systems being controlled by the sensor 18 of the FIG. 1 arrangement, whereas the second system comprises a further temperature sensor 29 on the object 26 to be cooled, in conjunction with a regulating device 30 which controls a vacuum valve 31 in the exhaust line 28 in such a way that the temperature of the object 26 to be cooled can also be kept constant.

Figure 8:
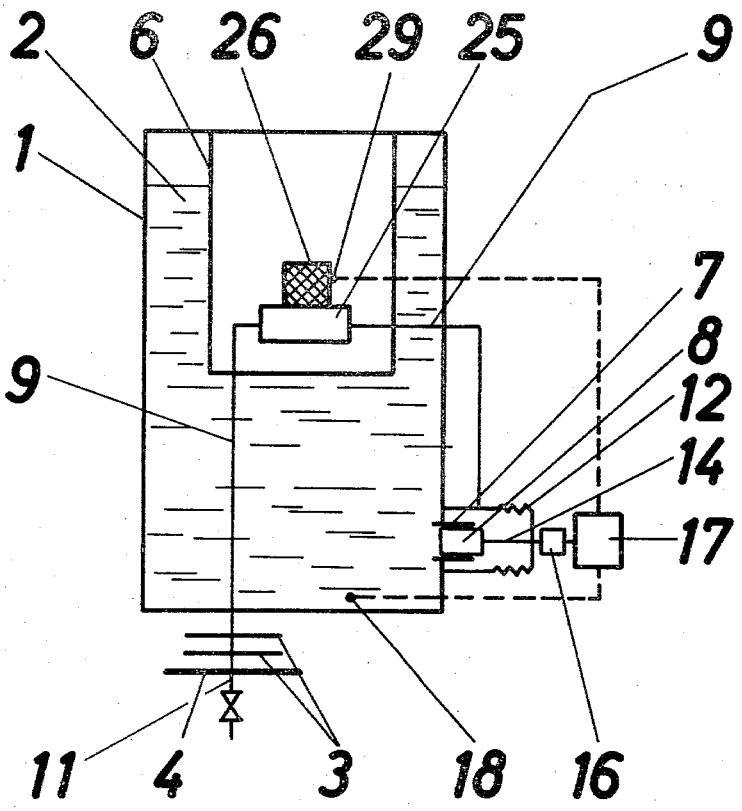
FIG. 8 shows a cryogenic apparatus according to this invention which incorporates a heat-exchanger on the object to be cooled.

In the simplified arrangement shown in FIG. 8, only the heat-exchanger 25 in contact with the object 26 to be cooled is provided and the valve 7, 8 is controlled in dependence upon the temperature of the object as determined by the temperature sensor 29. In this case the sensor 18 in the refrigerating medium 2 is here used only to control the valve 7, 8, during the cooling and filling of the entire system.

Referring again to the operation of the apparatus of FIG. 1 different phases are possible during stationary operation, i.e. following cooling of the entire system from room temperature to helium temperature, charging of the supply of refrigerating medium and setting of an operating temperature of less than 2° K. In all cases, during operation, the exhaust system 9 is connected at 11 either to a vacuum pump or is opened to space so that, by way of the exhaust-system, gas emerges due to evaporation of helium II, which gas occurs at the outlet end of the valve 7, 8, and at this point a lower pressure level than in the supply container is maintained. If superfluid helium II is superposed at the inlet end of the valve, then the thermomechanical effect occurs at the annular gap in the valve i.e. no liquid can pass through the valve, and instead only a certain quantity of helium, depending upon the pressure-differential across the valve and the length of the annular gap, is able to evaporate at the outlet end of the annular gap.

The refrigerating capacity available in the system and corresponding to the heat of evaporation of the evaporating helium II can be regulated in a very sensitive manner in this phase of the operation by varying the length of the annular gap. i.e. by displacing the valve plunger 8 in the sleeve 7, the annular gap remaining constant. Because of the very great thermal conductivity of helium II, a quantity of heat passing from the exterior or from the object to be cooled is immediately evenly distributed in the refrigerating medium, so that, by way of the sensor 18, the temperature of this medium can be used for controlling the valve. A further operating phase occurs when, with helium II superposed on the valve, it is necessary to create a greater refrigerating capacity than the maximum that is possible when using a constant annular gap with the flow of liquid cut off. Then, the valve in the forms illustrated in FIGS. 2 to 6 can be operated in an additional control range wherein the width of gap is more than 10 μm, and liquid in quantities corresponding to the required refrigerating capacity can be released in controlled amounts into the exhaust-system. This liquid vaporises completely in the heat-exchanger 10, which is positioned in the refrigerating medium 2. In this way, fluctuating as well as large changes in thermal load can be evened out with little inertia.

During movement of the apparatus, e.g. upon starting, landing or intermediate acceleration during space missions in suitable carrier systems and particularly when the supply of refrigerating medium is giving out, the superposing of liquid on the valve 7, 8 can be briefly or continuously discontinued. However, this operational condition does not lead to difficulties such as occur with the known porous plugs. In this case, phase-separation takes place within the supply container, and helium gas can be pumped off through the valve 7, 8 when opened beyond the 10 μm range of the annular gap, or the liquid reaching the valve as a result of film flow can be evaporated. The throughput of gas or liquid corresponding to the refrigerating capacity required in the system can also be satisfactorily regulated in this operating condition.

This also applies in the case of the operating phase wherein the supply of liquid refrigerant is heated to temperatures greater than 2.18° K. and therefore consists of normally liquid helium I. In the case of helium I as well, a valve of this kind, when opening beyond the annular gap range, permits regulation of the throughput of a vaporizable quantity of fluid and, therefore, regulation of the refrigerating capacity. Thus, an undesirable rise in temperature, which leads to the conversion of helium II into the normal liquid helium I range, can be levelled out again by a corresponding increase in the refrigerating capacity which is immediately passed to the supply of refrigerating medium by way of the heat-exchanger 10, and the prescribed required temperature can be reestablished in the helium II range.

The apparatus illustrated in FIGS. 7 and 8 operates in accordance with the same basic principles. The only differences to be observed here relate to the discharging of the exhaust gas and the arrangement of the heat exchanger in relation to the object to be cooled.

What I claim is:

1. A cryogenic apparatus for cooling objects to and maintaining them at very low temperatures by the evaporation of superfluid helium II using confinement produced by the thermomechanical effect, said apparatus comprising:

a supply container containing therein a supply of superfluid helium II;

an evacuable exhaust system;

a throttle element extending through said supply container and opening into said exhaust system, such that said superfluid helium II is evaporated through said throttle element into said exhaust system;

said throttle element being in the form of a valve comprising a valve sleeve and a valve element mounted for axial displacement relative to said valve sleeve;

said valve sleeve and said valve element defining therebetween in a normal control range a passage gap having a width of less than 10 μm and a length which is variable by relative axial displacement between said valve sleeve and said valve element; and control means, connected to said valve element, for controlling the relative axial position of said valve element with respect to said valve sleeve and for thereby controlling the evaporation of said superfluid helium II through said throttle element into said exhaust system.

2. A cryogenic apparatus as claimed in claim 1, wherein said valve has an additional control range, dependent on the relative axial position between said valve sleeve and said valve element, in which the gap width is greater than 10 μm.

3. A cryogenic apparatus as claimed in claim 2, wherein the gap width is adjustable up to a fully open position.

4. A cryogenic apparatus as claimed in claim 1, wherein said valve element comprises a cylindrical plunger which is axially movable within said valve sleeve and defines therewith an annular gap having a width less than 10 μm.

5. A cryogenic apparatus as claimed in claim 4, wherein said sleeve and plunger are so shaped as to define, over a portion of the path of movement of said plunger, a gap having a width greater than 10 μm.

6. A cryogenic apparatus as claimed in claim 5, wherein said plunger is tapered at one end thereof.

7. A cryogenic apparatus as claimed in claim 5, wherein said plunger has at least one tapered recess at one end thereof.

8. A cryogenic apparatus as claimed in claim 5, wherein said sleeve has therein at least one recess extending from one end thereof into an annular channel which is formed in said sleeve between the ends thereof.

9. A cryogenic apparatus as claimed in claim 1, wherein said exhaust system includes at least one heat exchanger which is positioned within said supply container in heat exchange relationship with said supply of superfluid helium II therein.

10. A cryogenic apparatus as claimed in claim 1, wherein said exhaust system includes at least one heat exchanger which is positioned in heat exchange relationship with an object to be cooled.

11. A cryogenic apparatus as claimed in claim 1, wherein said exhaust system includes two lines extending from said valve, a first said line including a first heat exchanger positioned in said supply container, and a second said line including a second heat exchanger positioned in heat exchange relationship with an object to be cooled, and said exhaust system includes means for independently evacuating said two lines.

12. A cryogenic apparatus for maintaining an object at a constant temperature below 2° K., said apparatus comprising:

container means for comprising therein a supply of refrigerating medium normally comprising superfluid helium II;

chamber means, within said container means, for housing an object;

an evacuable exhaust system;

a valve connecting the interior of said container means to said exhaust system, said valve comprising a fixed sleeve and a cylindrical plunger mounted for axial movement within said sleeve, said sleeve and plunger defining therebetween an annular gap which has a width of less than 10 μm and a length which is variable upon axial movement of said plunger within said sleeve, such that said refrigerating medium is evaporated through said annular gap into said exhaust system;

means for sensing the temperature of an object within said chamber means; and control means, connected to said plunger and operable in response to said sensing means, for moving said plunger axially relative to said sleeve, and for thereby controlling the degree of evaporation of said refrigerating medium and thus the temperature of the object.

* * * * *